US005456324A

United States Patent [19]

Takagi et al.

[11] Patent Number: 5,456,324

[45] Date of Patent: Oct. 10, 1995

[54] PERCUSSION HAMMER

[75] Inventors: Toshiaki Takagi, Katsuta; Yoshihiko Watanabe, Ibaraki, both of Japan

[73] Assignee: Hitachi Koki Company Limited, Tokyo, Japan

[21] Appl. No.: 277,025

[22] Filed: Jul. 19, 1994

[30] Foreign Application Priority Data

Nov. 26, 1993 [JP] Japan ..... 5-063532 U

[51] Int. Cl.[6] ..... B25D 11/04

[52] U.S. Cl. ..... 173/48; 173/109

[58] Field of Search ..... 173/48, 47, 104, 173/109, 201

[56] References Cited

U.S. PATENT DOCUMENTS

| | | | |
|---|---|---|---|
| 4,066,136 | 1/1978 | Wanner et al. | 173/48 |
| 4,236,588 | 12/1980 | Möldam et al. . | |
| 4,274,304 | 6/1981 | Curtiss | 173/48 |
| 5,111,890 | 5/1992 | Ranger et al. . | |
| 5,379,848 | 1/1995 | Rauser | 173/48 |

FOREIGN PATENT DOCUMENTS

| | | |
|---|---|---|
| 61-19395 | 5/1986 | Japan . |
| 4500043 | 1/1992 | Japan . |

*Primary Examiner*—Scott A. Smith

*Attorney, Agent, or Firm*—Pollock, Vande Sande & Priddy

[57] ABSTRACT

A percussion hammer for a tool includes a rotational drive source. A motion converting mechanism is connected to the rotational drive source for convening rotational movement of the rotational drive source into reciprocating movement. A striking mechanism is connected to the motion converting mechanism, and has a drive cylinder. A rotation transmitting mechanism is operative for transmitting rotational movement from the rotational drive source to the tool. A drive wheel is connected to the rotational drive source, and extends around the drive cylinder. A coupling member is connected to the drive cylinder, and extends around the drive cylinder. The coupling member is movable in a percussion axis direction. A movable adjustment member is connected to the coupling member for selectively connecting and disconnecting the coupling member to and from the drive wheel. Teeth are formed on an outer circumferential surface of the drive cylinder. A casing has an inner circumferential surface formed with a projection or a recess extending in the percussion axis direction. A sleeve has an outer circumferential portion which mates in shape with the projection or the recess of the casing. The sleeve engages the casing via the projection or the recess of the casing, and is movable in the percussion axis direction. Teeth are formed on the sleeve, and mate in shape with the teeth on the drive cylinder. The adjustment member is connected to the sleeve for selectively moving the teeth on the sleeve into and out of engagement with the teeth on the drive cylinder.

4 Claims, 3 Drawing Sheets

PERCUSSION HAMMER

BACKGROUND OF THE INVENTION

1. Field of the Invention

This invention relates to a percussion hammer such as an electric hammer drill which has a motion converting mechanism, a striking mechanism, and a rotation transmitting mechanism.

2. Description of the Prior Art

Japanese published examined patent application 61-19395 (corresponding to U.S. Pat. No. 4,236,588) and Japanese published unexamined patent application 4-500043 (corresponding to U.S. Pat. No. 5,111,890) disclose hammer drills in which a movable coupling member is located between a drive wheel and a drive cylinder which engages a tool holder. The coupling member is changed among three different positions by an adjustment member. When the coupling member assumes a first position, the drive wheel and the drive cylinder are connected via the coupling member so that rotational movement is transmitted from the drive wheel to the drive cylinder. When the coupling member assumes a second position, the drive wheel and the drive cylinder are disconnected from each other so that the transmission of rotational movement therebetween is interrupted. When the coupling member assumes a third position, the drive cylinder is disconnected from the drive wheel and is simultaneously locked to a casing of the hammer drill by the coupling member.

During operation of the above-indicated hammer drills in which the coupling member is changed between the first position and the third position, loads or forces of significantly different levels act on the connection between the coupling member and the drive wheel and the connection between the coupling member and the casing respectively. Accordingly, it is generally difficult to optimally design the coupling member with respect to such loads or forces of different levels.

In the above-indicated hammer drills, the coupling member has a first engagement portion for providing the connection with the drive wheel and a second engagement portion for providing the connection with the casing. If the first engagement portion of the coupling member breaks while the second engagement portion thereof is normal, it is necessary to replace the whole of the coupling member.

SUMMARY OF THE INVENTION

It is an object of this invention to provide an improved percussion hammer.

A first aspect of this invention provides a percussion hammer for a tool which comprises a rotational drive source; a motion converting mechanism connected to the rotational drive source for converting rotational movement of the rotational drive source into reciprocating movement; a striking mechanism connected to the motion converting mechanism and having a drive cylinder; a rotation transmitting mechanism for transmitting rotational movement from the rotational drive source to the tool; a drive wheel connected to the rotational drive source and extending around the drive cylinder; a coupling member connected to the drive cylinder and extending around the drive cylinder, the coupling member being movable in a percussion axis direction; a movable adjustment member connected to the coupling member for selectively connecting and disconnecting the coupling member to and from the drive wheel; teeth formed on an outer circumferential surface of the drive cylinder; a casing having an inner circumferential surface formed with a projection or a recess extending in the percussion axis direction; a sleeve having an outer circumferential portion which mates in shape with the projection or the recess of the casing, the sleeve engaging the casing via the projection or the recess of the casing and being movable in the percussion axis direction; and teeth formed on the sleeve and mating in shape with the teeth on the drive cylinder; the adjustment member being connected to the sleeve for selectively moving the teeth on the sleeve into and out of engagement with the teeth on the drive cylinder.

A second aspect of this invention provides a percussion hammer for a tool which comprises a rotational drive source; a motion converting mechanism connected to the rotational drive source for converting rotational movement of the rotational drive source into reciprocating movement; a striking mechanism connected to the motion converting mechanism and having a drive cylinder; a rotation transmitting mechanism for transmitting rotational movement from the rotational drive source to the tool; a drive wheel connected to the rotational drive source and extending around the drive cylinder; a coupling member connected to the drive cylinder and extending around the drive cylinder, the coupling member being movable in a percussion axis direction; a movable adjustment _member connected to the coupling member for selectively connecting and disconnecting the coupling member to and from the drive wheel; teeth formed on an outer circumferential surface of the drive cylinder; a casing having an inner circumferential surface formed with a projection or a recess extending in the percussion axis direction; a sleeve having an outer circumferential portion which mates in shape with the projection or the recess of the casing, the sleeve engaging the casing via the projection or the recess of the casing and being movable in the percussion axis direction; and teeth formed on the sleeve and mating in shape with the teeth on the drive cylinder; the adjustment member being connected to the sleeve for selectively moving the teeth on the sleeve into and out of engagement with the teeth on the drive cylinder; wherein the adjustment member provides movement of the coupling member in the percussion axis direction, and movement of the sleeve in the percussion axis direction which is asynchronous with the movement of the coupling member.

A third aspect of this invention provides a percussion hammer comprising a casing; a rotatable drive wheel; a drive cylinder; first means for selectively coupling and uncoupling the drive cylinder to and from the drive wheel, the first means including a coupling member which is movably connected to the drive cylinder and which is able to selectively move into and out of connection with the drive wheel; second means for selectively locking and unlocking the drive cylinder to and from the casing, the second means including a locking member which is movably connected to the casing and which is able to selectively move into and out of connection with the drive cylinder, the locking member being separate from the coupling member; a movable adjustment member; and third means connected among the first means, the second means, and the adjustment member for controlling the coupling member and the locking member in response to movement of the adjustment member.

It is preferable that the third means comprises means for asynchronously moving the coupling member and the locking member in response to the movement of the adjustment member.

DESCRIPTION OF THE PREFERRED EMBODIMENT

Figure 1:
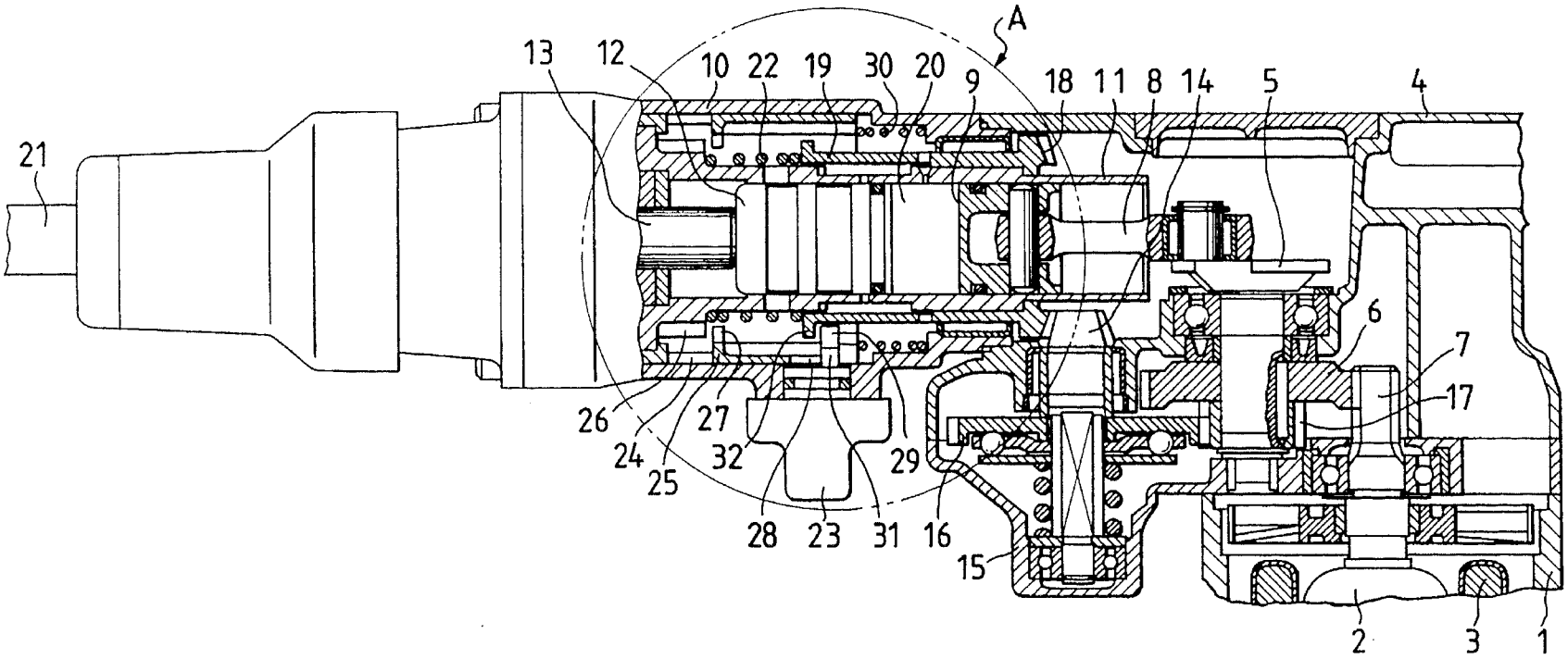
FIG. 1 is a sectional view of a hammer drill according to an embodiment of this invention.

With reference to FIG. 1, a hammer drill has a housing 1 which accommodates a motor including a rotor 2 and a stator 3. The rotor 2 of the motor is a rotational drive source. A crank casing 4 fixed to the housing 1 accommodates and supports a rotatable crankshaft 5. A gear 6 and a pinion 17 are key-coupled with the crankshaft 5 so that they rotate together with the crankshaft 5. The rotor 2 of the motor has a pinion 7 which meshes with the gear 6. Therefore, the crankshaft 5 rotates in accordance with rotation of the rotor 2. The crankshaft 5 is connected to a cylindrical piston 9 via a connection rod 8. As the crankshaft 5 rotates, the piston 9 axially reciprocates. As will be made clear later, the axial direction with respect to the piston 9 agrees with a percussion axis direction. The gear 6, the crankshaft 5, and the connection rod 8 compose a motion converting mechanism for changing rotation of the rotor 2 into axial reciprocation of the piston 9.

A casing 10 fixed to the crank casing 4 accommodates and supports a rotatable drive cylinder 11 in which the piston 9, an end striker 12, and an intermediate striker 13 are slidably disposed. The intermediate striker 13 extends in the rear of a tool 21 held by a tool holder connected to the drive cylinder 11. The drive cylinder 11, the end striker 12, and the intermediate striker 13 compose a striking mechanism which operates on the tool 21.

A pinion 14 is rotatably supported in the crank casing 4 and a gear cover 15. The axis of the pinion 14 extends perpendicular to the axis of the drive cylinder 11. The gear cover 15 is fixed to the housing 1 and the casing 10. A gear 16 mounted on the pinion 14 meshes with the pinion 17. The teeth of the pinion 17 mesh with corresponding teeth on a drive wheel 18 which is rotatably mounted on the drive cylinder 11. Therefore, the drive wheel 18 rotates in response to rotation of the rotor 2. The drive wheel 18 extends around the drive cylinder 11.

A coupling sleeve or member 19 extends around the drive cylinder 11. The coupling member 19 is key-coupled with the drive cylinder 11 so that the coupling member 19 can move axially relative to the drive cylinder 11, and that the coupling member 19 and the drive cylinder 11 can rotate together. Thus, the coupling member 19 is movable in the axial direction which agrees with the percussion axis direction.

The combination of the rotor 2, the gear 6, the crankshaft 5, the connection rod 8, and the piston 9 converts rotation of the rotor 2 into axially reciprocating motion of the piston 9. As the piston 9 moves axially toward the end striker 12, an air chamber 20 defined between the piston 9 and the end striker 12 is compressed and thereby the end striker 12 is forced axially toward the intermediate striker 13. Thus, the end striker 12 collides against the intermediate striker 13. The collision between the strikers 12 and 13 results in a strike against the tool 21. As previously described, the end striker 12, the intermediate striker 13, and the drive cylinder 11 compose a striking mechanism which operates on the tool 21.

The combination of the rotor 2, the gear 6, the crankshaft 5, the pinion 17, the gear 16, the pinion 14, and the drive wheel 18 causes rotation of the drive wheel 18 in response to rotation of the rotor 2.

Figure 2:
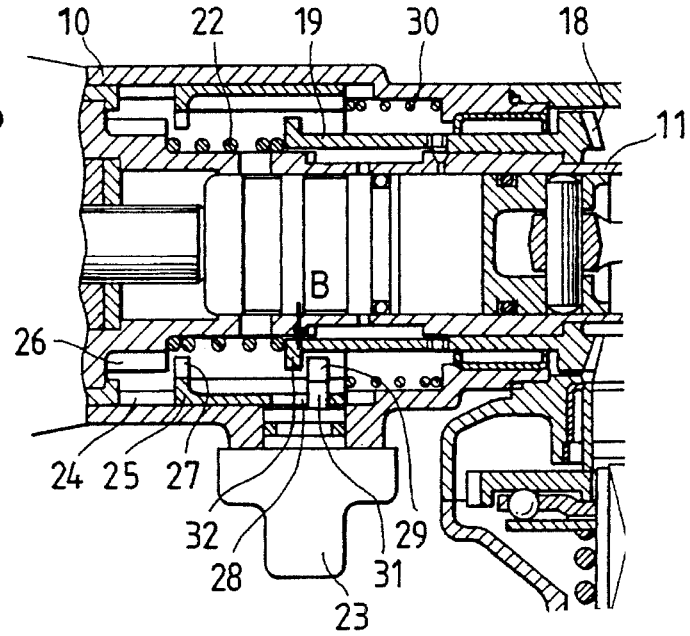
FIG. 2 is an enlarged ,dew of the portion in FIG. 1 which is denoted by the letter "A".
Figure 3:
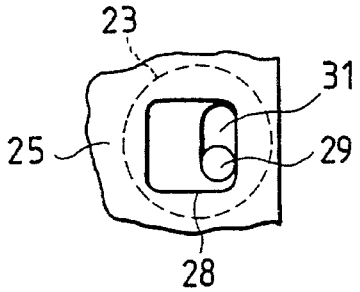
FIG. 3 is a view in the direction of the arrow "B" in FIG. 2.

With reference to FIGS. 1, 2, and 3, a rotatable adjustment member 23 supported on the casing 10 extends through the walls of the casing 10. The adjustment member 23 can be manually operated. An inner end of the adjustment member 23 has a cam 31 and an eccentric pin 29. A sleeve (a locking member) 25 slidably fits within the casing 10. The sleeve 25 is movable in the axial direction which agrees with the percussion axis direction. The cylindrical walls of the sleeve 25 have a square opening 28. The cam 31 on the adjustment member 23 extends through the square opening 28 in the sleeve 25 and engages the walls of the sleeve 25 which define the square opening 28. The eccentric pin 29 on the adjustment member 23 can engage a flange 32 formed at a left-hand end of the coupling member 19.

A left-hand end of the drive wheel 18 has teeth which can mesh with teeth on a right-hand end of the coupling member 19. As the coupling member 19 moves axially toward and away from the drive wheel 18, the right-hand end of the coupling member 19 moves into and out of engagement with the left-hand end of the drive wheel 18. A spring 22 provided between the left-hand end of the coupling member 19 and a step on the drive cylinder 11 urges the coupling member 19 toward the drive wheel 18.

An inner surface of the casing 10 has an axially-extending projection or recess 24. An outer surface of the sleeve 25 has an axially-extending recess or projection which mates with the projection or recess 24 of the casing 10. Thus, the sleeve 25 is key-coupled with the casing 10 so that the sleeve 25 can move axially relative to the casing 10 but can not rotate relative thereto. A left-hand end of the sleeve 25 has teeth 27 which can mesh with teeth 26 on a predetermined left-hand region of the outer surfaces of the drive cylinder 11. As the sleeve 25 moves axially toward and away from the predetermined region of the drive cylinder 11, the teeth 27 on the sleeve 25 move into and out of engagement with the teeth 26 on the drive cylinder 11. A spring 30 provided between a step on the casing 10 and a right-hand end of the sleeve 25 urges the sleeve 25 toward the predetermined region of the drive cylinder 11.

When the adjustment member 23 is set to a position shown in FIGS. 2 and 3, the spring 22 moves the coupling member 19 into engagement with the drive wheel 18. On the other hand, the teeth 27 on the sleeve 25 are disconnected from the teeth 26 on the drive cylinder 11. Thus, in this case, the coupling member 19 rotates together with the drive wheel 18, and the drive cylinder 11 also rotates together with the coupling member 19. As the drive cylinder 11 rotates, the tool holder and the tool 21 rotate. The gear 6, the crankshaft 5, the pinion 17, the gear 16, the pinion 14, the drive wheel 18, the coupling member 19, the drive cylinder 11, and the tool holder compose a mechanism (a rotation transmitting mechanism) for transmitting rotational movement from the rotor 2 to the tool 21.

Figure 4:
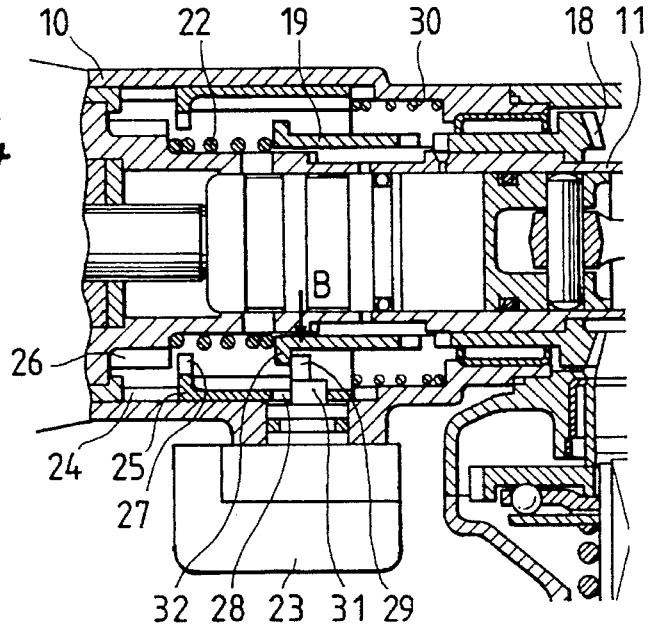
FIG. 4 is an enlarged view of the portion in FIG. 1 which is denoted by the letter "A".
Figure 5:
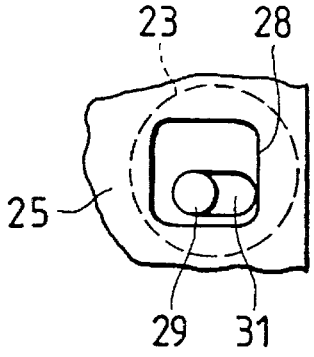
FIG. 5 is a view in the direction of the arrow "B" in FIG. 4.

As the adjustment member 23 is rotated from the position of FIGS. 2 and 3 to a position shown in FIGS. 4 and 5, the eccentric pin 29 rotates about the center of the adjustment member 23 and engages the flange 32 on the coupling member 19. Then, the eccentric pin 29 moves the coupling member 19 away from the drive wheel 18 so that the coupling member 19 is disconnected from the drive wheel 18. The teeth 27 on the sleeve 25 remain disconnected from the teeth 26 on the drive cylinder 11 by operation of the cam 31 with respect to the sleeve 25. Thus, in this case, the transmission of rotational movement from the drive wheel 18 to the drive cylinder 11 is interrupted, and the drive cylinder 11 can be freely rotated relative to the casing 10. Accordingly, it is possible to execute a process of locating the tool 21 in a rotational direction (an angular direction).

The drive wheel 18 and the coupling member 19 compose a clutch controlled by the adjustment member 23. The clutch selectively couples and uncouples the drive wheel 18 to and from the drive cylinder 11 regarding rotational motion.

Figure 6:
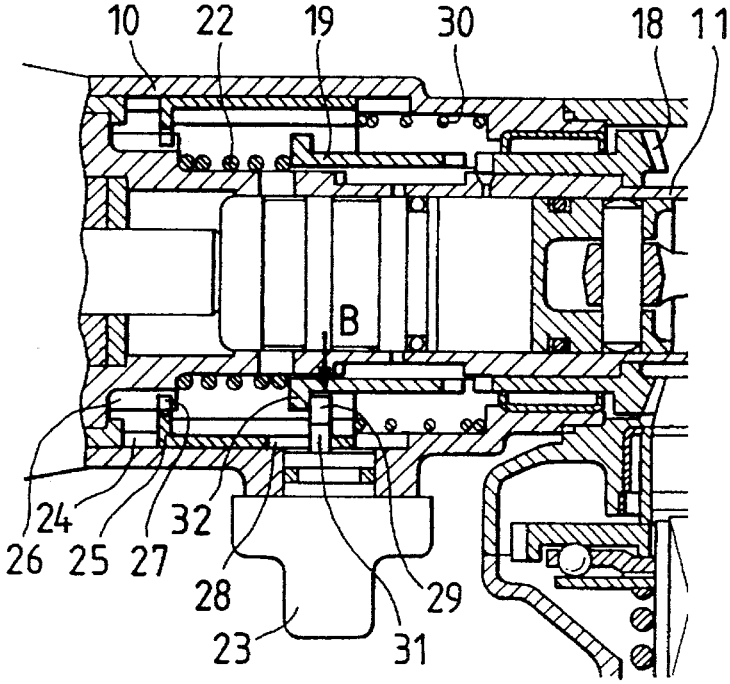
FIG. 6 is an enlarged view of the portion in FIG. 1 which is denoted by the letter "A".
Figure 7:
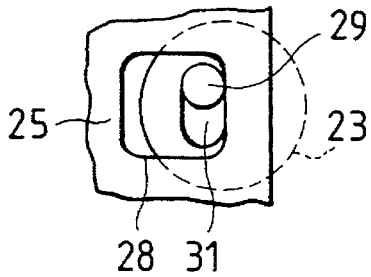
FIG. 7 is a view in the direction of the arrow "B" in FIG. 6.

As the adjustment member 23 is rotated from the position of FIGS. 4 and 5 to a position shown in FIGS. 6 and 7, the eccentric pin 29 rotates about the center of the adjustment member 23 and remains in engagement with the flange 32 on the coupling member 19. During this period, the cam 31 permits the sleeve 25 to be moved by the spring 30 toward the teeth 26 on the drive cylinder 11. As a result, the teeth 27 on the sleeve 25 move into engagement with the teeth 26 on the drive cylinder 11, and the drive cylinder 11 is locked to the casing 10. On the other hand, in this case, the eccentric pin 29 holds the coupling member 19 disconnected from the drive wheel 18. Accordingly, the position of the tool 21 is fixed with respect to the casing 10.

The coupling member 19 serves to selectively permit and inhibit the transmission of rotational movement from the drive wheel 18 to the drive cylinder 11. The sleeve 25 serves to selectively locks and unlocks the drive cylinder 11 to and from the casing 10. The coupling member 19 and the sleeve 25 are controlled by the adjustment member 23. The control of the coupling member 19 and the sleeve 25 by the adjustment member 23 is designed so that axial movement of the coupling member 19 will be asynchronous with axial movement of the sleeve 25. Accordingly, the necessary axial stroke of the coupling member 19 can be shorter than that of a prior-art coupling member which has both the function of selectively permitting and inhibiting the transmission of rotational movement and the function of selectively locking and unlocking a drive cylinder.

The coupling member 19 and the sleeve 25 tend to be subjected to loads or forces of different levels respectively. Since the coupling member 19 and the sleeve 25 are separate members, it is possible to optimally design both the coupling member 19 and the sleeve 25 with respect to such loads or forces of different levels. In this regard, it is preferable that the coupling member 19 is made of, for example, steel while the sleeve 25 is made of, for example, resin.

As previously described, the coupling member 19 and the sleeve 25 are separate members. If one of the coupling member 19 and the sleeve 25 breaks while the other is normal, it is unnecessary to replace the other. This is advantageous in cost.

What is claimed is:

1. A percussion hammer for a tool, comprising:

a rotational drive source;

a motion converting mechanism connected to the rotational drive source for converting rotational movement of the rotational drive source into reciprocating movement;

a striking mechanism connected to the motion converting mechanism and having a drive cylinder;

a rotation transmitting mechanism for transmitting rotational movement from the rotational drive source to the tool;

a drive wheel connected to the rotational drive source and extending around the drive cylinder;

a coupling member connected to the drive cylinder for rotation therewith and extending around the drive cylinder, the coupling member being movable in a percussion axis direction relative to the drive cylinder;

a movable adjustment member connected to the coupling member for selectively connecting and disconnecting the coupling member to and from the drive wheel;

teeth formed on an outer circumferential surface of the drive cylinder;

a casing having an inner circumferential surface formed with a projection extending in the percussion axis direction;

a sleeve having an outer circumferential portion which mates in shape with the projection of the casing, the sleeve engaging the casing via the projection of the casing and being movable in the percussion axis direction; and teeth formed on the sleeve and mating in shape with the teeth on the drive cylinder;

the adjustment member being connected to the sleeve for selectively moving the teeth on the sleeve into and out of engagement with the teeth on the drive cylinder; wherein the adjustment member provides movement of the coupling member in the percussion axis direction, and movement of the sleeve in the percussion axis direction which is asynchronous with the movement of the coupling member.

2. A percussion hammer for a tool, comprising:

a rotational drive source:

a motion convening mechanism connected to the rotational drive source for converting rotational movement of the rotational drive source into reciprocating movement;

a striking mechanism connected to the motion converting mechanism and having a drive cylinder;

a rotation transmitting mechanism for transmitting rotational movement from the rotational drive source to the tool;

a drive wheel connected to the rotational drive source and extending around the drive cylinder;

a coupling member connected to the drive cylinder for rotation therewith and extending around the drive cylinder, the coupling member being movable in a percussion axis direction relative to the drive cylinder;

a movable adjustment member connected to the coupling member for selectively connecting and disconnecting the coupling member to and from the drive wheel;

teeth formed on an outer circumferential surface of the drive cylinder;

a casing having an inner circumferential surface formed with a recess extending in the percussion axis direction;

a sleeve having an outer circumferential portion which mates in shape with the recess of the casing, the sleeve engaging the casing via the recess of the casing and being movable in the percussion axis direction; and teeth formed on the sleeve and mating in shape with the teeth on the drive cylinder;

the adjustment member being connected to the sleeve for selectively moving the teeth on the sleeve into and out of engagement with the teeth on the drive cylinder;

wherein the adjustment member provides movement of the coupling member in the percussion axis direction, and movement of the sleeve in the percussion axis direction which is asynchronous with the movement of the coupling member.

3. A percussion hammer comprising:

a casing;

a rotatable drive wheel;

a drive cylinder;

first means for selectively coupling and uncoupling the drive cylinder to and from the drive wheel, the first means including a coupling member which is connected to the drive cylinder for rotation therewith and axially movable relative thereto and which is able to selectively move into and out of connection with the drive wheel;

second means for selectively locking and unlocking the drive cylinder to and from the casing, the second means including a locking member which is movably connected to the casing and which is able to selectively move into and out of connection with the drive cylinder, the locking member being separate from the coupling member;

a movable adjustment member; and third means connected among the first means, the second means, and the adjustment member for controlling the coupling member and the locking member in response to movement of the adjustment member.

4. The percussion hammer of claim 3, wherein the third means comprises means for asynchronously moving the coupling member and the locking member in response to the movement of the adjustment member.

* * * * *